US010583656B2

(12) United States Patent
Kato et al.

(10) Patent No.: US 10,583,656 B2
(45) Date of Patent: Mar. 10, 2020

(54) LIQUID DISCHARGE HEAD, RECORDING APPARATUS, AND METHOD OF MANUFACTURING LIQUID DISCHARGE HEAD

(71) Applicant: CANON KABUSHIKI KAISHA, Tokyo (JP)

(72) Inventors: Masataka Kato, Hiratsuka (JP); Toshiyasu Sakai, Kawasaki (JP); Atsunori Terasaki, Kawasaki (JP); Takayuki Kamimura, Kawasaki (JP); Shuichi Tamatsukuri, Asaka (JP); Hiroshi Higuchi, Atsugi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/013,757

(22) Filed: Jun. 20, 2018

(65) Prior Publication Data

US 2019/0001675 A1 Jan. 3, 2019

(30) Foreign Application Priority Data

Jun. 29, 2017 (JP) ..... 2017-127997

(51) Int. Cl.
*B41J 2/14* (2006.01)
*B41J 2/16* (2006.01)

(52) U.S. Cl.
CPC ..... *B41J 2/1433* (2013.01); *B41J 2/14129* (2013.01); *B41J 2/162* (2013.01);
(Continued)

(58) Field of Classification Search
CPC .... B41J 2/1433; B41J 2/14129; B41J 2/1631; B41J 2/1628; B41J 2/1642; B41J 2/1603;
(Continued)

(56) References Cited

U.S. PATENT DOCUMENTS 7,250,113 B2 7/2007 Komuro
7,731,338 B2 6/2010 Min
(Continued)

FOREIGN PATENT DOCUMENTS

CN 1415479 A 5/2003
EP 0906828 A2 4/1999
(Continued)

OTHER PUBLICATIONS

Translation of JP 2002-029057, published on Jan. 2002. (Year: 2002).*

*Primary Examiner* — Huan H Tran
(74) *Attorney, Agent, or Firm* — Canon USA, Inc., IP Division

(57) ABSTRACT

A liquid discharge head includes a substrate that is provided with a supply passage having an opening; an energy generating element that is disposed on a surface of the substrate; an electric wiring layer; an insulation layer; and a discharge port member that forms a discharge port. The insulation layer has an end portion adjacent to the opening of the supply passage and set back from an edge of the opening of the supply passage toward a side where the energy generating element is disposed. The electric wiring layer includes a plurality of electric wiring layers layered on each other.

15 Claims, 8 Drawing Sheets

(52) U.S. Cl.
CPC ..... *B41J 2/1603* (2013.01); *B41J 2/1626* (2013.01); *B41J 2/1628* (2013.01); *B41J 2/1631* (2013.01); *B41J 2/1642* (2013.01); *B41J 2002/14491* (2013.01); *B41J 2202/12* (2013.01); *B41J 2202/18* (2013.01); *B41J 2202/22* (2013.01)

(58) Field of Classification Search
CPC ..... B41J 2/162; B41J 2/1626; B41J 2202/18; B41J 2202/12; B41J 2002/14491; B41J 2202/22; B41J 2/01
See application file for complete search history.

(56) References Cited

U.S. PATENT DOCUMENTS

| | | | | |
|---|---|---|---|---|
| 7,963,635 | B2 * | 6/2011 | Oikawa | B41J 2/1404 347/61 |
| 8,518,725 | B2 * | 8/2013 | Terasaki | B41J 2/1603 438/21 |
| 10,035,346 | B2 * | 7/2018 | Kasai | B41J 2/14129 |
| 2003/0027426 | A1 | 2/2003 | Milligan | |
| 2008/0165222 | A1 | 7/2008 | Hayakawa | |
| 2009/0147056 | A1 * | 6/2009 | Oikawa | B41J 2/1404 347/61 |
| 2009/0225136 | A1 | 9/2009 | Fujii | |
| 2010/0171793 | A1 | 7/2010 | Jeong | |
| 2010/0317130 | A1 | 12/2010 | Hayakawa | |
| 2015/0290935 | A1 | 10/2015 | Tamatsukuri | |

FOREIGN PATENT DOCUMENTS

| | | | |
|---|---|---|---|
| EP | 3050707 | A2 | 8/2016 |
| JP | H09-254432 | A | 9/1997 |
| JP | 10-034928 | A | 2/1998 |
| JP | 10-095119 | A | 4/1998 |
| JP | 2002-029057 | A | 1/2002 |
| JP | 2011-161915 | A | 8/2011 |
| JP | 2015-066909 | A | 4/2015 |

* cited by examiner

LIQUID DISCHARGE HEAD, RECORDING APPARATUS, AND METHOD OF MANUFACTURING LIQUID DISCHARGE HEAD

BACKGROUND OF THE INVENTION

Field of the Invention

The present disclosure relates to a liquid discharge head, a recording apparatus, and a method of manufacturing a liquid discharge head.

Description of the Related Art

A liquid discharge head used in a recording apparatus of an ink jet printer and the like includes, for example, a channel above a substrate in which a supply passages is formed, an energy generating element that. applies energy to a liquid in the channel, and a discharge port through which the liquid is discharged. Japanese Patent Laid-Open No. 2011-161915 discloses a liquid discharge head including a substrate that has two through ports, which are supply passages. The through ports are constituted by independent supply passages that are individually separated from each other and a common supply passage shared by the independent supply passages. Using such individually-separated independent supply passages to supply the liquid therethrough into the channel above the substrate improves efficiency in liquid supplying and stabilizes a liquid discharge direction. Thus, recording by highly accurate high-speed liquid discharging is enabled.

In general, to increase recording speed, a liquid discharge head is required to increase speed when replenishing (refilling), after liquid discharging, a liquid into a channel above an energy generating element. The replenishing speed is effectively increased by, for example, reducing the length of the channel extending from a supply passage to the energy generating element to thereby reduce flow resistance. Japanese Patent Laid-Open Nos. 10-095119 and 10-034928 each disclose a liquid discharge head in which a substrate is etched at a portion thereof in the vicinity of a supply passage so that the height of a channel in the vicinity of the supply passage is increased. In such a liquid discharge head, flow resistance from the supply passage to an energy generating element is reduced, and refilling efficiency is improved.

In each liquid discharge head disclosed in Japanese Patent Laid-Open Nos. 10-095119 and 10-034928, the substrate itself is etched, which sometimes makes it difficult to form a wiring layer and the like on the substrate. In addition, it is highly likely that the etched substrate is exposed to an etchant or an ink, leading to an issue in terms of reliability. Moreover, when the substrate itself is etched, there are issues relating to manufacturing. For example, it is difficult to form, for example, a wiring layer on the substrate after the substrate is etched. It is also difficult to control etching depth of the substrate, which sometimes reduces reliability due to variation in the shape of the substrate.

Merely reducing the flow resistance is achieved by disposing the supply passage in the vicinity of the energy generating element. However, disposing the supply passage in the vicinity of the energy generating element also affects a wiring layer disposed in the vicinity of the energy generating element. In addition, disposing the energy generating element between two supply passages or disposing the energy generating element between a supply passage and a collecting channel also causes issues. Such a configuration includes a partition disposed between the supply passages (or between the supply passage and the collecting channel); in this case, when the supply passages or the supply passage is disposed closer to the energy generating element, the thickness of the partition is reduced. As a result, the mechanical strength of the partition decreases; therefore, for example, the liquid discharge head is easily damaged when vibration, force of impact, or the like is applied thereto, or the yield of substrates in a manufacturing process decreases, which may reduce the reliability of the liquid discharge head.

SUMMARY OF THE INVENTION

According to the present disclosure, a liquid discharge head includes a substrate that is provided with a supply passage having an opening on a front surface side of the substrate and through which a liquid is supplied onto the front surface side of the substrate; an energy generating element that is disposed on a front surface of the substrate and generates energy for discharging a liquid; an electric wiring layer that is electrically connected to the energy generating element; an insulation layer that electrically insulates the electric wiring layer from the liquid; and a discharge port member that forms a discharge port through which the liquid is discharged. The insulation layer has an end portion adjacent to the opening of the supply passage. The end portion is set back from an edge of the opening of the supply passage toward a side where the energy generating element is disposed. The electric wiring layer includes a plurality of electric wiring layers layered on each other.

Further features of the present disclosure will become apparent from the following description of exemplary embodiments with reference to the attached drawings.

DESCRIPTION OF THE EMBODIMENTS

The present disclosure provides a highly reliable liquid discharge head in which flow resistance for a liquid supplied through a supply passage onto an energy generating element is low. Hereinafter, a liquid discharge head according to an embodiment of the present disclosure will be described with reference to the drawings. Note that the embodiment described below includes specific description to sufficiently describe the present disclosure; however, the specific description is merely a technical example and does not particularly limit the scope of the present disclosure.

The liquid discharge head is a member included in a recording apparatus such as an ink jet printer. The recording apparatus also includes, for example, a conveyance mechanism that conveys a recording medium on which recording is performed and a liquid storage part that stores a liquid to be supplied to the liquid discharge head.

Figure 1:
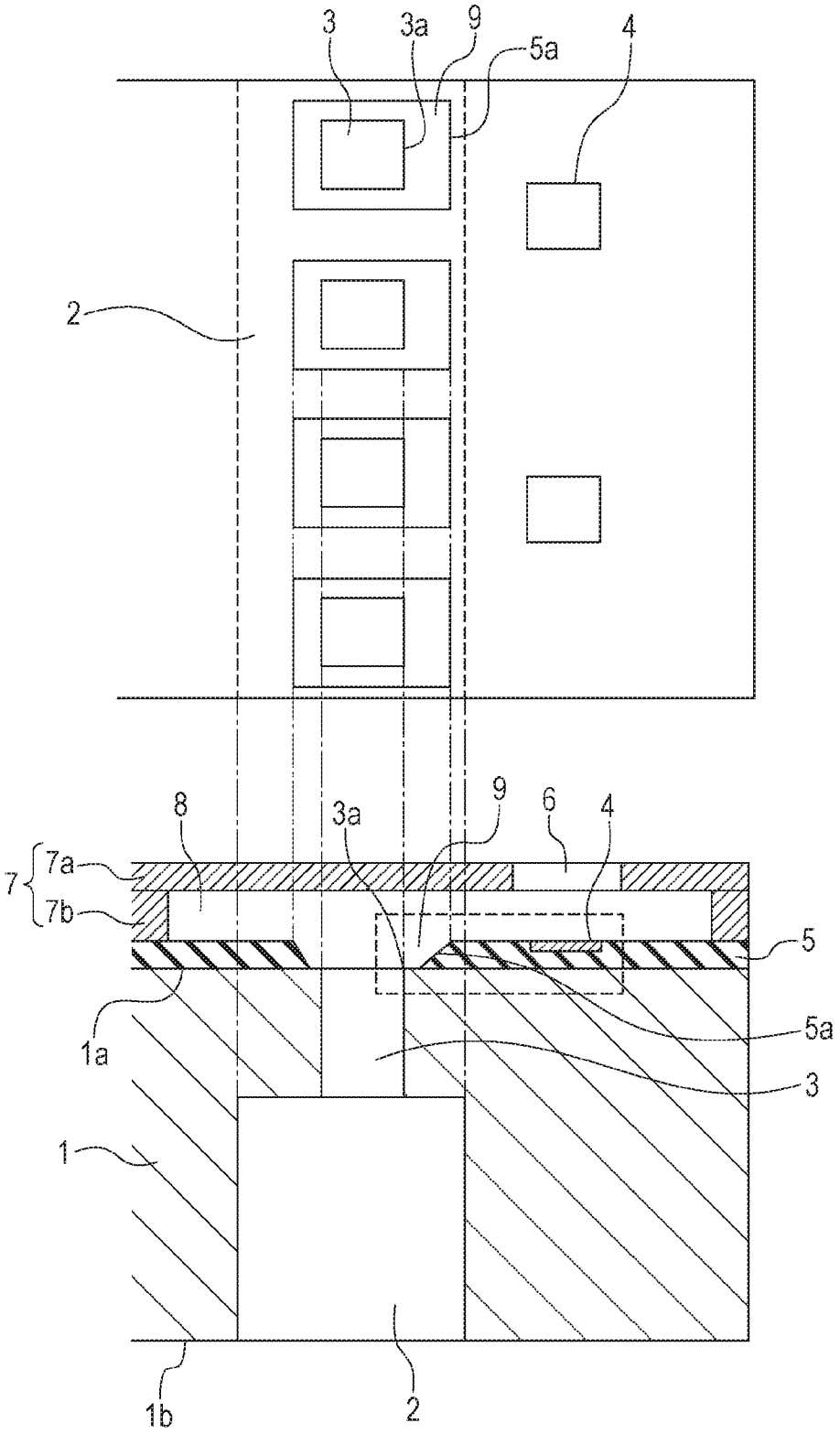
FIG. 1 illustrates an upper surface and a cross section of liquid discharge head.

FIG. 1 shows a plan view and a sectional view of the liquid discharge head according to the present embodiment of the disclosure. The liquid discharge head includes a substrate 1. The substrate 1 is formed of, for example, silicon. The substrate 1 includes at least one supply passage that passes through the substrate 1 between a front surface 1*a* and a rear surface 1*b* thereof. Referring to FIG. 1, the supply passage is constituted by two types of supply passages, which are at least one first supply passage 2 and a plurality of second supply passages 3. The supply passage has at least one opening on each of the front surface side and the rear surface side of the substrate 1. The liquid is supplied from the rear surface side to the front surface side of the substrate 1 through the supply passage. The substrate 1 is provided, on the front surface thereof, with at least one energy generating element 4 that generates energy for discharging a liquid, an electric wiring layer (not shown) that is electrically connected to the energy generating element 4, and an insulation layer 5 that electrically insulates the electric wiring layer from the liquid. The energy generating element 4 is formed of, for example, TaSiN. The electric wiring layer is formed of, for example, Al. The insulation layer 5 is formed of, for example, silicone nitride (SiN), silicon carbide (SiC), or silicon oxide (SiO, $SiO_2$). The insulation layer 5 has at least one opening 9 in which the supply passage (second supply passages) is open. In addition, the substrate 1 is provided, on the front surface thereof, with a discharge port member 7 that forms at least one discharge port 6 through which the liquid is discharged. Referring to FIG. 1, the discharge port member 7 includes two layers that are a discharge-port formation portion 7*a* and a channel formation portion 7*b*. The discharge port member 7 is formed of, for example, resin (epoxy resin or the like), silicon, or metal. A region surrounded by the discharge port member 7 and the front surface of the substrate 1 is a channel 8 for the liquid. In the channel 8, a portion that includes the energy generating element 4 is also considered as a pressure chamber. After energy is applied to the liquid in the pressure chamber by the energy generating element 4, the liquid is discharged through the discharge port 6.

As described above, the supply passage is constituted by the at least one first supply passage 2 and the plurality of second supply passages 3. The plurality of independently separated second supply passages 3 are provided per first supply passage 2. Thus, the first supply passage 2 can be considered as a common supply passage, and the second supply passages 3 can be considered as independent supply passages. In the present embodiment, the supply passage is constituted by the two types of supply passages, such as the first supply passage 2 and the second supply passages 3; however, the supply passage may be constituted by a single supply passage. That is, for example, the substrate 1 may include a single vertical supply passage that passes therethrough.

Figure 2:
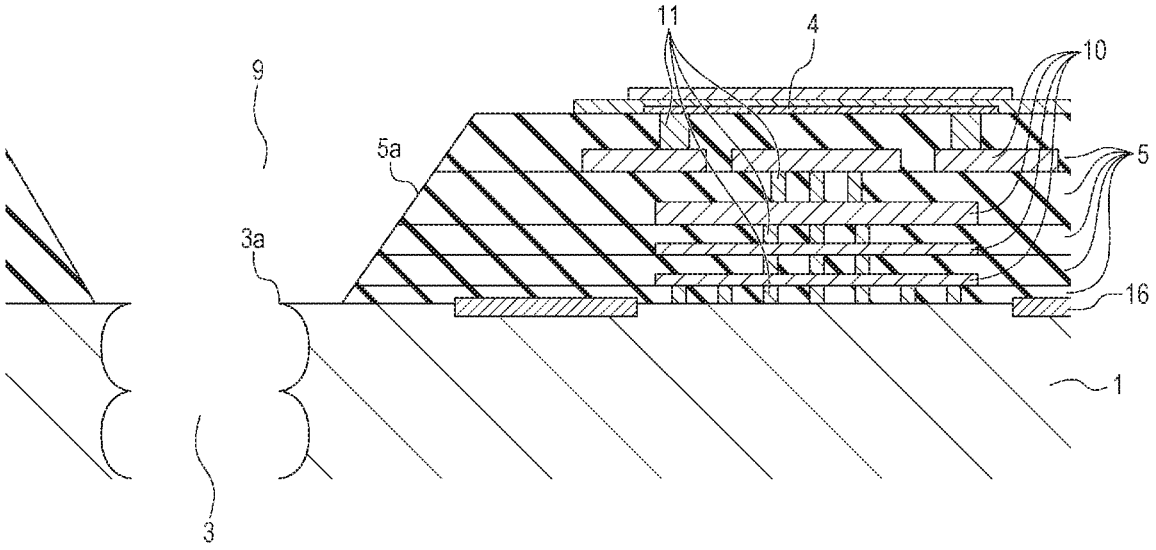
FIG. 2 illustrates the cross section of the liquid discharge head.

FIG. 2 shows an enlarged view of a region surrounded by the dashed line in FIG. 1, that is, a portion that is on the front surface side of the substrate 1 and in the vicinity of an opening of one of the second supply passages 3. Referring to FIG. 2, a side wall of the second supply passage 3 has a shape indicated by wavy lines. Such a shape tends to be formed in the second supply passages 3 that are formed by the Bosch process. An oxide film 16 formed on the front surface side of the substrate 1 and is overlaid with the insulation layer 5. The insulation layer 5 includes a plurality of insulation layers layered on each other and is formed by, for example, plasma chemical vapor deposition (CVD). An electric wiring layer 10 is disposed between the layers of the insulation layer 5. The electric wiring layer 10 also includes a plurality of electric wiring layers layered on each other and connected together via plugs 11. The plugs 11 are, for example, tungsten plugs. The insulation layer 5 is present where no plugs 11 are present. Thus, the layers of the electric wiring layer 10 are electrically partially, where no plugs 11 are present, insulated from each other by the insulation layer 5. The electric wiring layer 10 is electrically connected to the energy generating element 4 and supplies electric power to the energy generating element 4.

Figure 8:
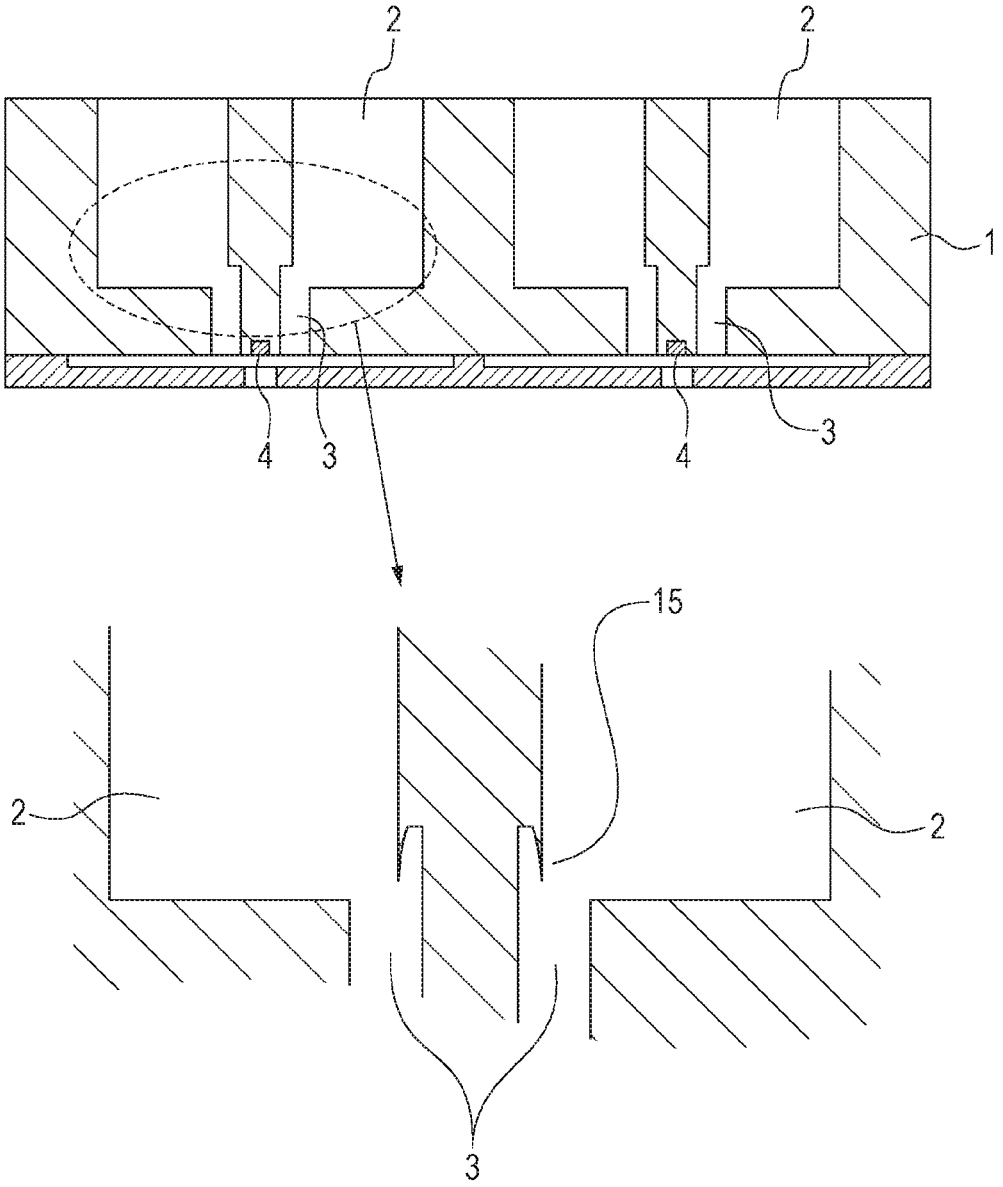
FIG. 8 illustrates a cross section of a liquid discharge head in which burrs are formed.

As described above, to increase recording speed, the liquid discharge head is required to increase speed when replenishing (refilling), after liquid discharging, the liquid onto the energy generating element. Therefore, in the form described with reference to FIGS. 1 and 2, to reduce as much as possible the length of the channel necessary for refilling, for example, the second supply passage 3 (independent supply passage), in which the flow resistance is lower than that in the first supply passage 2, is disposed closer to the energy generating element 4. Simply, only the second supply passage 3 is disposed closer to the energy generating element 4 while the first supply passage 2 stays as is. In this case, however, a connection portion between the first supply passage 2 and the second supply passage 3 is formed into a crank shape, as illustrated in FIG. 8. In particular, when the crank shape of the connection portion between the first supply passage 2 and the second supply passage 3 is formed by reactive ion etching, a burr 15 is sometimes formed at a portion having the crank shape. Thus, it is difficult to accurately form the connection portion.

Therefore, the present embodiment of the disclosure focuses on the insulation layer formed on the front surface of the substrate instead of focusing on the positional relationship between the first supply passage 2 and the second supply passage 3. According to the embodiment, the insulation layer is, for example, etched at a portion thereof in the vicinity of the second supply passage 3 such that an end portion of the insulation layer is spaced from the opening of the supply passage, thereby improving refilling efficiency. Specifically, as illustrated in FIGS. 1 and 2, the insulation layer 5 has an end portion 5*a* adjacent to the opening of the second supply passage 3. The end portion 5*a* is set back from an edge 3*a* of the opening of the second supply passage 3 toward a side where the energy generating element 4 is disposed. As a result, a region in which no insulation layer 5 is present is increased, and in turn, the flow resistance for the liquid is reduced, which enables the liquid to flow easily. Therefore, it is possible to improve the refilling efficiency.

As illustrated in FIG. 1, when the liquid discharge head is viewed from a position opposite the front surface 1*a* of the substrate 1, the end portion 5*a* forms an opening of the insulation layer 5. The opening of the insulation layer 5 surrounds the edge 3*a* of the opening of the second supply passage 3. Here, the center of the opening of the insulation layer 5 and the center of the opening of the second supply passage 3 may not coincide with each other. The insulation layer 5 may also have, on a side where no energy generating element 4 is present as viewed from the opening of the second supply passage 3, the end portion 5*a* adjacent to the opening of the second supply passage 3. In this case, a set-back position (position of the end portion 5*a* of the insulation layer 5 set back from the edge 3*a* of the opening of the second supply passage 3) of the end portion 5*a* of the insulation layer 5 may be closer, on the side where no energy generating element 4 is present, to the edge 3*a* of the opening of the second supply passage 3 than on a side where the energy generating element 4 is present. From the point of view of refilling, the position of the end portion 5*a* of the insulation layer 5 on the side where the energy generating element 4 is present is more important. Thus, the end portion 5*a* is set back further, on the side where the energy generating element 4 is present, than on the other side from the edge 3*a* in order to prevent the end portion 5*a* of the insulation layer 5 from being excessively set back on the side where no energy generating element 4 is present and affecting arrangement of the wiring layer.

Flow resistance for the liquid is simply reduced by, for example, etching the front surface 1*a* of the substrate 1 to lower, at a position in the vicinity of the opening of the supply passage, the height of the substrate 1. In other words, a step is formed on the front surface 1*a* of the substrate 1 itself. However, it is desirable to form a step by setting back the end portion 5*a* of the insulation layer 5 from the opening of the supply passage as is in the present embodiment. This is to reduce the effect of etching the substrate 1 with respect to, for example, the arrangement of the wiring layer. This is also to avoid exposing the etched substrate 1 to an etchant or an ink. Moreover, the height of the insulation layer 5 substantially equals to the height (height of the opening 9) of the step, which enables accurate control of the height of the step. In particular, when the substrate 1 and the insulation layer 5 are formed of different materials, an etching rate is different between etching of the substrate 1 and etching of the insulation layer 5. In addition, when the substrate 1 is formed of silicon, and the insulation layer insulation layer 5 is formed of silicon nitride, silicon carbide, silicon oxide, or the like, the etching rate for the substrate 1 is considerably lower than the etching rate for the insulation layer 5 if the substrate 1 and the insulation layer 5 are etched by reactive ion etching. Thus, the substrate 1 capable of functioning as an etching stop layer during etching of the insulation layer 5. This also enables desirable control of the height (height of the opening 9 of the insulation layer 5) and the shape of the step.

The electric wiring layer may include a plurality of electric wiring layers layered on each other. As a result, the height of the insulation layer 5 is increased, which makes it possible to improve the refilling efficiency when the end portion of the insulation layer 5 is set back from the opening of the supply passage. Specifically, the thickness of the insulation layer 5 is preferably 4 μm or more. More preferably, the thickness of the insulation layer 5 is 6 μm or more. When the insulation layer 5 includes a plurality of layers, the thickness of the insulation layer 5 is the total thickness of the layers. When one or a plurality of electric wiring layers are provided between the layers of the insulation layer 5, the thickness of the insulation layer 5 includes the thickness of the electric wiring or the total thickness of the plurality of electric wiring layers. The above limitations on the thickness of the insulation layer 5 achieve an increase in the height of the opening 9 of the insulation layer 5 to thereby reduce the flow resistance for the liquid. The insulation layer does not particularly have an upper limit in terms of the thickness thereof; however, the thickness of the insulation layer is preferably 20 μm or less in consideration of the overall design of the liquid discharge head.

Figure 3:
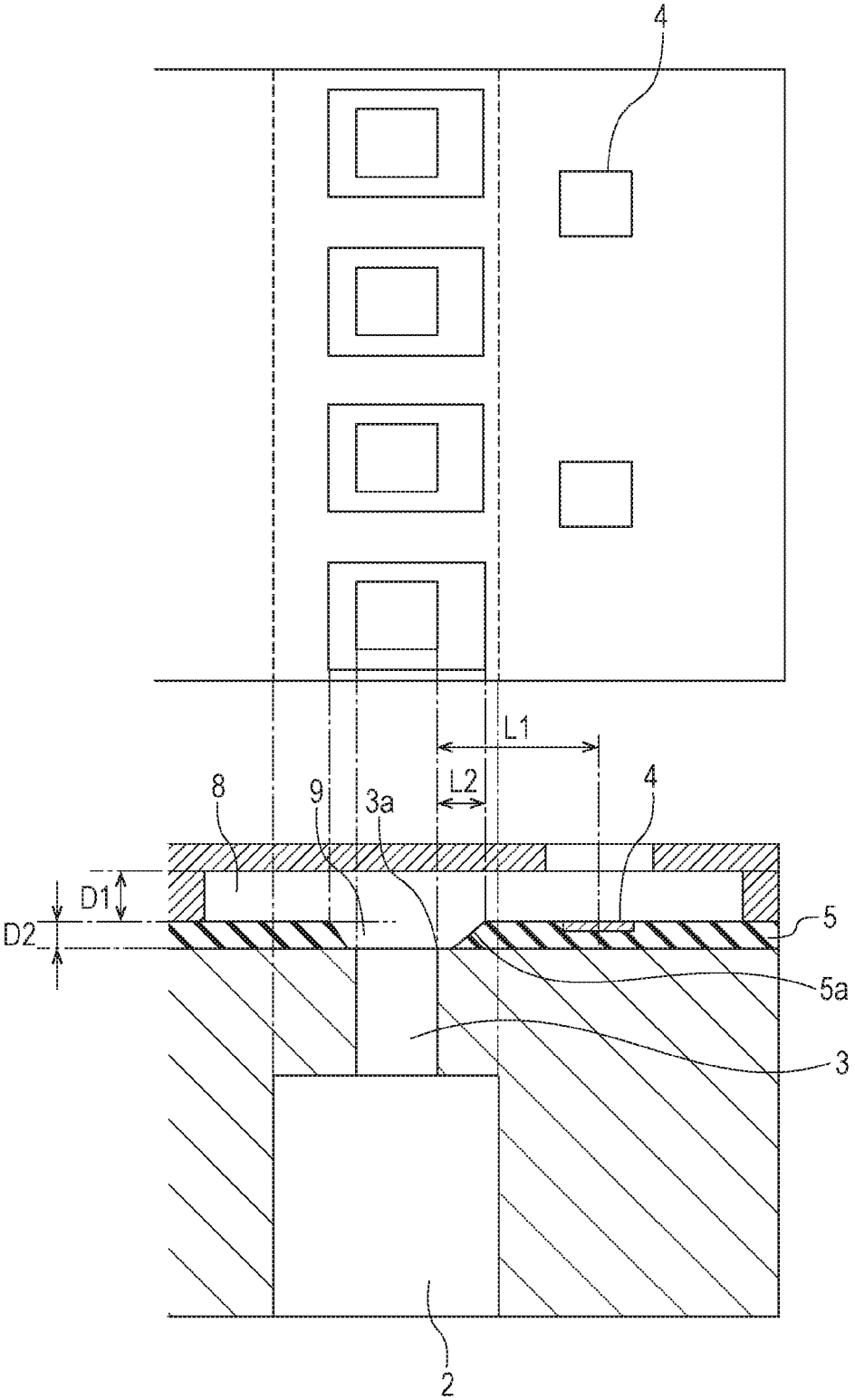
FIG. 3 illustrates the upper surface and the cross section of the liquid discharge head.

FIG. 3 shows a relationship between the edge 3*a* of the opening of the second supply passage 3 and the end. portion 5*a* (opening 9) of the insulation layer 5. L1 is a distance between the edge 3*a* of the opening of the second supply passage 3 and the center of the energy generating element 4. L2 is a distance between the edge 3*a* of the opening of the second supply passage 3 and the end portion 5*a* of the insulation layer 5. Note that each of the distance L1 and the distance L2 is the shortest distance when the liquid discharge head is viewed from the position opposite the front surface of the substrate 1. The center of the energy generating element 4 is the position of the center of gravity of the energy generating element 4. When the end portion 5*a* of the insulation layer 5 has a surface of a tapered shape or the like, the end portion 5*a* is a portion of the tapered surface at a position (in FIG. 3, the position where the tapered surface crosses the upper surface of the insulation layer 5) closest to the energy generating element 4. In this case, L2/L1 is preferably 0.2 or more. Limiting L2/L1 to 0.2 or more enables the flow resistance for the liquid to be desirably reduced and the refilling efficiency to be improved. L2/L1 is more preferably 0.3 or more. L1 is preferably 30 μm or more and not more than 150 μm. L2 is preferably 10 μm or more and not more than 120 μm.

Referring to FIG. 3, D1 is a height of the channel 8, and D2 is the thickness of the insulation layer 5. Each of D1 and D2 is a distance in a vertical direction from the front surface of the substrate 1. D2/D1 is preferably 0.2 or more. Limiting D2/D1 to 0.2 or more also enables the flow resistance for the liquid to be desirably reduced and the refilling efficiency to be improved. D2/D1 is more preferably 0.5 or more and further more preferably 1.0 or more. D1 is preferably 3 μm or more and not more than 20 μm. D2 is preferably 4 μm or more and not more than 10 μm.

Note that the present embodiment presents an example in which no insulation layer 5 remains at a part where the insulation layer 5 is set back; however, a thin portion of the insulation layer 5 may remain between the end portion 5*a* and the edge 3*a* of the opening of the second supply passage 3. However, it is desirable that no insulation layer 5 is present at the part.

Reactive ion etching may be employed as a method of forming the opening 9 by etching the insulation layer 5. In particular, it is desirable to employ reactive ion etching when the insulation layer 5 includes a plurality of layers. In this case, for example, the insulation layer 5 is, first, coated with a positive resist and then patterned by being exposed to light, heated, and developed such that a mask formed. The heating may be performed at a temperature of 90° C. or more and not more than 120° C. This condition enables the mask to have an opening tapered at an angle of 90 degrees or more. Performing the reactive ion etching by using such a mask enables the end portion 5*a* of the insulation layer 5 to be inclined at an anqle of less than 90 degrees. As a result, the end portion 5*a* is formed into an inclined surface inclined with respect to the front surface 1*a* of the substrate 1. The formation of the inclined surface enables the liquid to desirably flow toward the energy generating element 4. The angle (angle formed on the side where the insulation layer 5 is present, by the end portion 5*a* ) formed by the inclined surface, which is the end portion 5*a* of the insulation layer 5, and the front surface 1*a* of the substrate 1 is preferably 45 degrees or more and. less than 90 degrees. As a result of limiting the angle to less than 90 degrees, the end portion 5*a* is formed into the inclined surface inclined with respect to the front surface 1*a* of the substrate 1. If the angle is less than 45 degrees, there is a possibility that wiring and the like are affected because the end portion 5*a* is widened excessively in a lateral direction. It is desirable, from the point of view of refilling efficiency, that the end portion 5*a* be tapered at an angle of 45 degrees or more and thereby positioned closer to the energy generating element 4 by a distance corresponding to the angle.

In the etching of the insulation layer 5 by using the aforementioned tapered mask, for example, a mixed gas of $C_4F_8$ gas, $CF_4$ gas, and Ar gas may be used as a gas to be used for the etching. In particu1ar, the channel may be formed by reactive ion etching employing an inductive coupling plasma (ICP) device. However, a reactive ion etching device that includes a plasma source of a different type may be employed. For example, an electron cyclotron resonance (ECR) device or a magnetic neutral line discharge (NLD) plasma device may be employed.

Conditions for the etching include, for example, adjusting a gas pressure and a gas flow rate so as to be in a range of 0.1 Pa to 5 Pa and in a range of 10 sccm to 1000 sccm, respectively, and adjusting a coil power and a platen power in a range of 1000 W to 2000 W and in a range of 300 W to 500 W, respectively. Such adjustment in these ranges increases verticality in etching. In the present embodiment, a method of forming the end portion 5*a* of the insulation layer 5 into a tapered shape is, for example, adjusting the conditions for the etching. Examples of parameters for the adjustment include increasing the flow rate of the $C_4F_8$ gas, which is the etching gas, or decreasing the platen power. Specifically, etching of the tapered shape is enabled by adjusting the flow rate of the $C_4F_8$ gas so as to be in a range of 5 sccm to 30 sccm and the platen power so as to be in a range of 50 W to 300 W.

Figure 4:
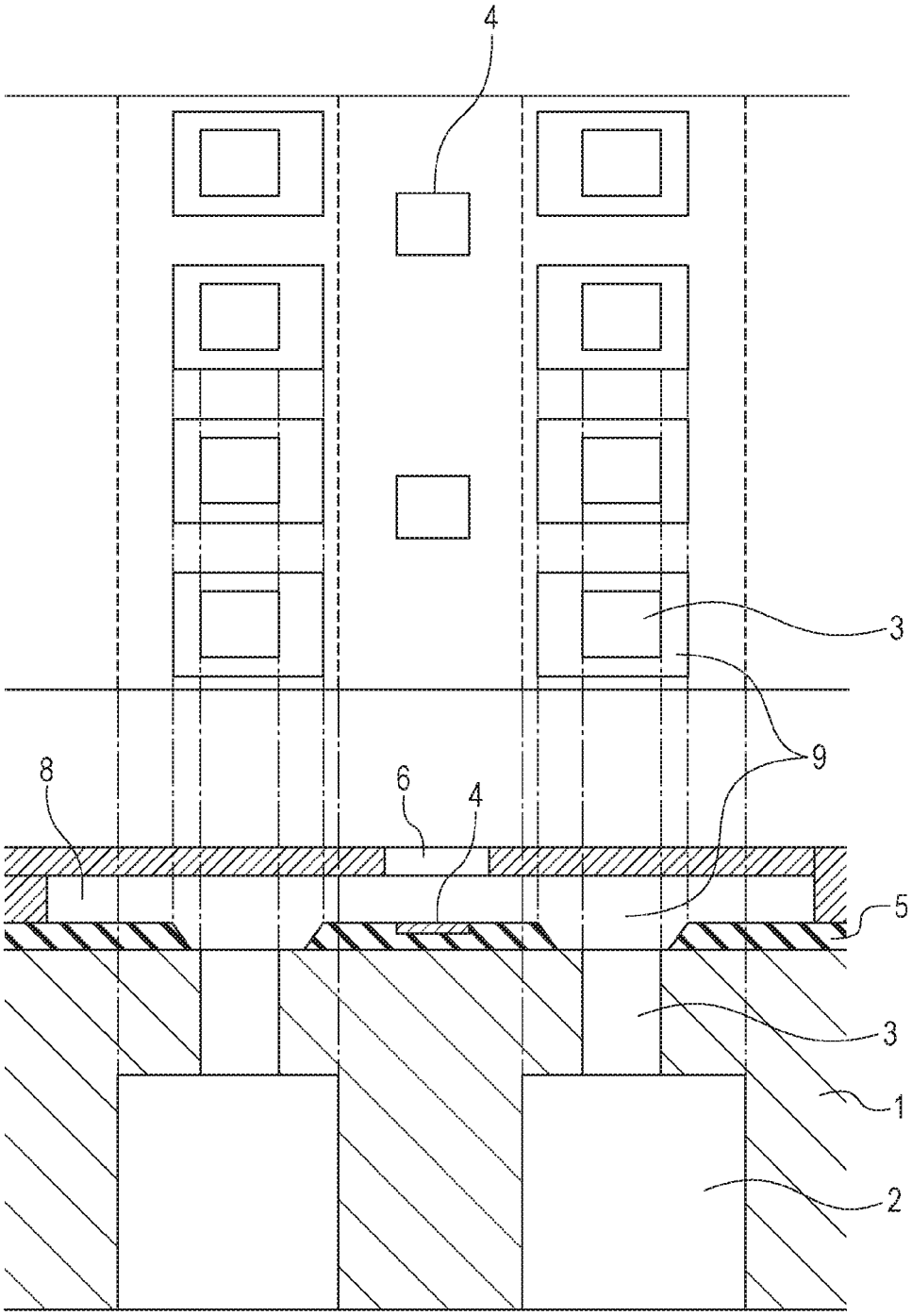
FIG. 4 illustrates an upper surface and a cross section of a liquid discharge head.

The liquid discharge head according to the present embodiment may have a configuration in which supply passages are disposed on respective opposing sides of at least one energy generating element so as to face each other. FIG. 4 illustrates an example of such a liquid discharge head. In the liquid discharge head illustrated in FIG. 4, each of the second supply passages 3 disposed on the respective opposing sides of the energy generating element 4 has at least one opening. The insulation layer 5 has end portions, on the respective opposing sides of the energy generating element 4, adjacent to the respective openings of the second supply passages 3. Each of the end portions is set back from an edge of the opening of the second supply passage 3 corresponding thereto toward the side where the energy generating element 4 is disposed.

Figure 5:
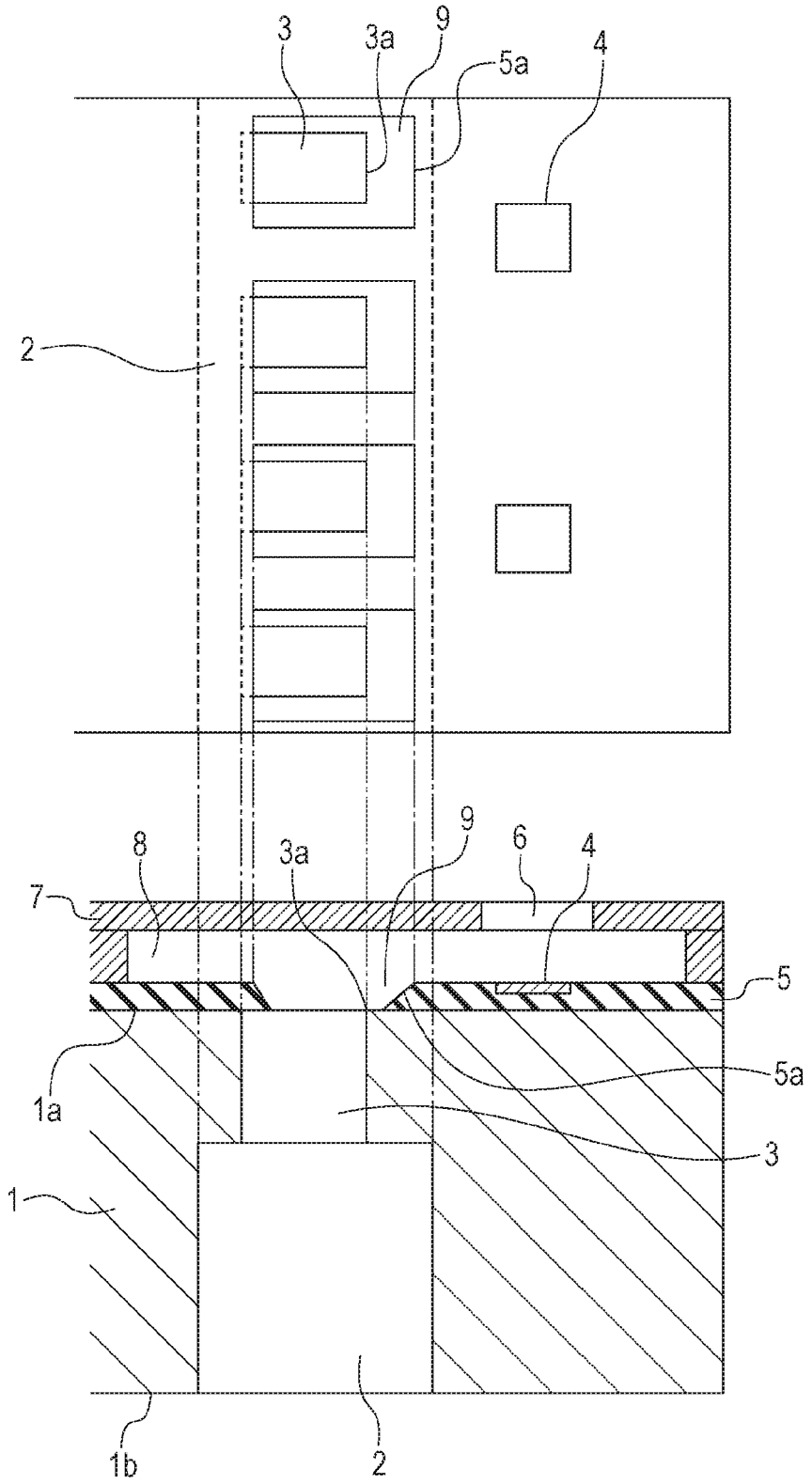
FIG. 5 illustrates an upper surface and a cross section of a liquid discharge head.
Figure 6:
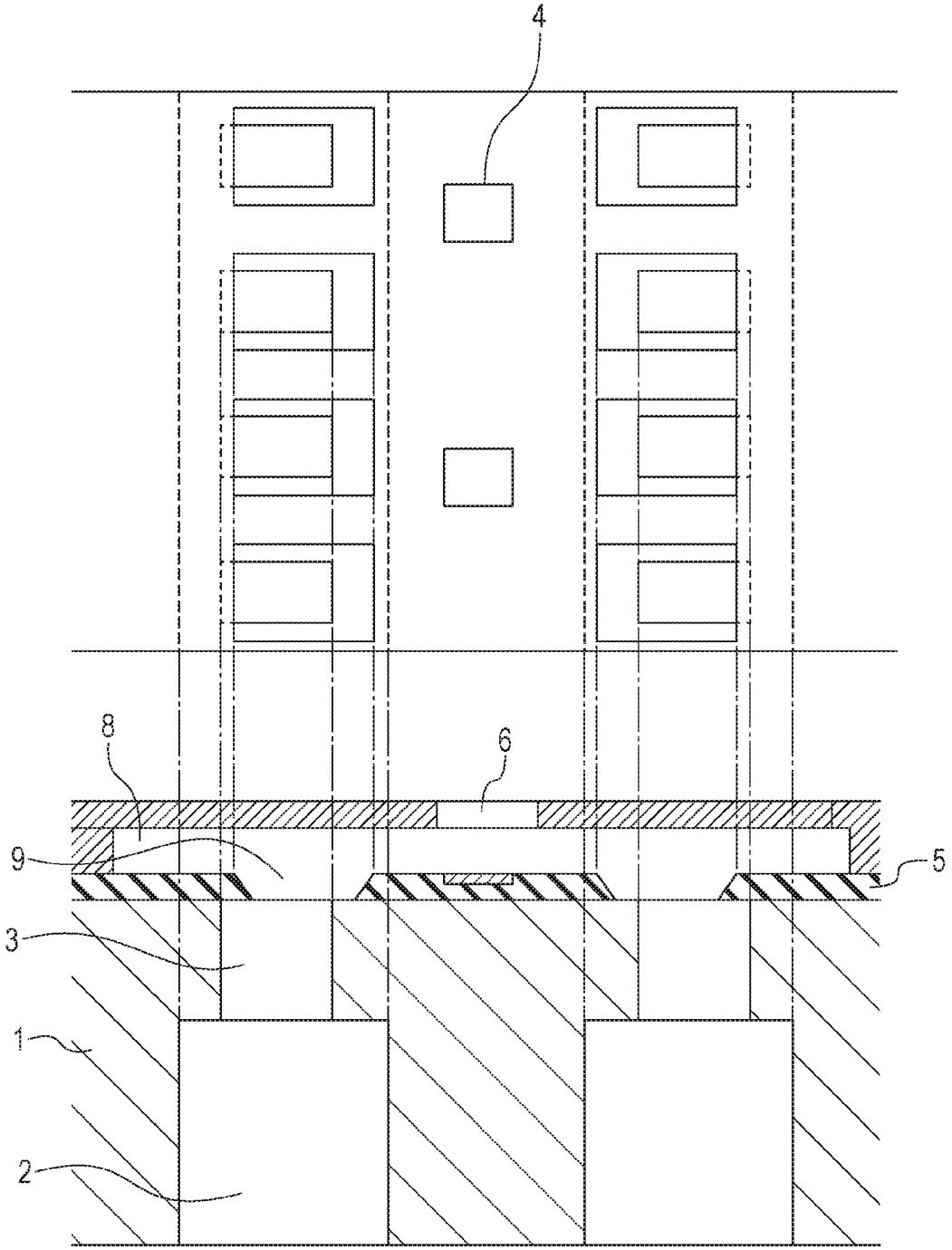
FIG. 6 illustrates an upper surface and a cross section of a liquid discharge head.

Moreover, as illustrated in FIG. 5, the liquid discharge head according to the present embodiment may have a configuration in which the insulation layer 5 protrudes, from a side of the supply passage opposite the side thereof where the energy generating element 4 is disposed, over the opening of the supply passage. In the form illustrated in FIG. 5, in the view from a position opposite the front surface of the substrate, a portion of the opening of the second supply passage 3 opens at a position further, than the position of the opening 9 of the insulation layer 5, from the energy generating element 4. Such a form is desirable because the liquid flows smoothly from the second supply passage 3 toward the energy generating element 4. As illustrated in FIG. 6, such a configuration is also applicable to the second supply passages 3 disposed on the respective opposing sides of the energy generating element 4 so as to face each other. In this case, it is desirable that the insulation layer 5 be disposed such that the end portions thereof adjacent to the respective openings of the second supply passages 3 disposed on the opposing sides of the energy generating element 4 are set back from the edges of the openings of the respective second supply passages 3 toward the side where the energy generating element 4 is disposed. As a result, one of the second supply passages 3 disposed on the opposing sides of the energy generating element 4 can be used as a discharge passage for the liquid, and thus, it is possible to circulate the liquid inside and outside of the channel (pressure chamber) 8. Moreover, the protrusion of the insulation layer 5, as illustrated in FIG. 6, contributes to smooth flowing of the liquid in the circulation and to suppression of backflow of the liquid in the discharge passage. The length of a portion of the insulation layer 5 protruding over the opening of the second supply passage 3 is preferably 0.1 μm or more and not more than 3.0 μm. More preferably, the length of the portion is 0.5 μm or more and not more than 1.5 μm.

Next, a method of manufacturing the liquid discharge head will described with reference to FIGS. 7A, 7B, 7C, 7D, 7E, and 7F.

Figure 7A:
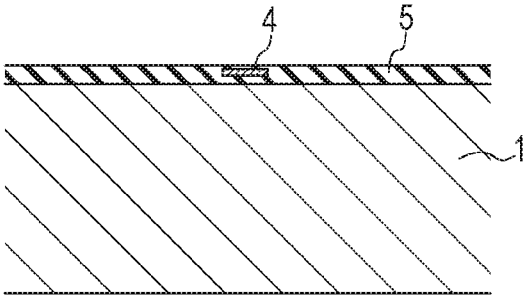
FIGS. 7A, 7B, 7C, 7D, 7E, and 7F illustrate a method of manufacturing a liquid discharge head.

First, as illustrated in FIG. 7A, the substrate 1 provided, on the front surface side thereof, with the energy generating element 4, the insulating layer 5, and the electric wiring layer (not shown) is prepared. The insulation layer 5 includes the plurality of insulation layers and is provided with at least one electric wiring layer between the insulation layers.

Figure 7D:
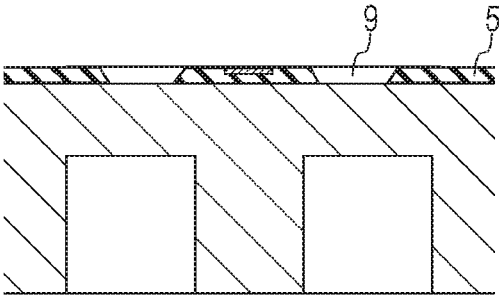
Figure 7B:
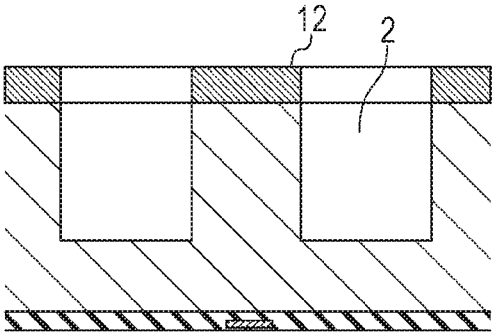

Next, as illustrated in FIG. 7B, an etching mask. 12 is provided on a rear surface side of the substrate 1, and the first supply passage 2 is formed by reactive ion etching. The etching mask 12 may be formed of, for example, silicon oxide, silicon nitride, silicon carbide, N-type silicon carbide, or a photosensitive resin.

Figure 7E:
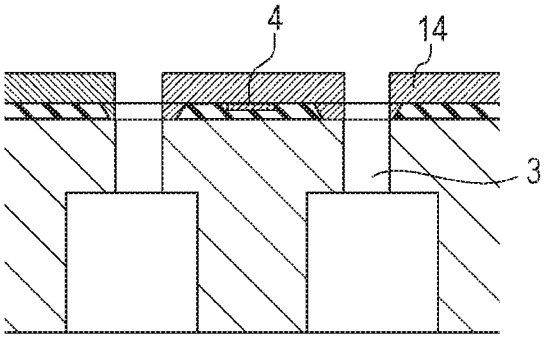
Figure 7C:
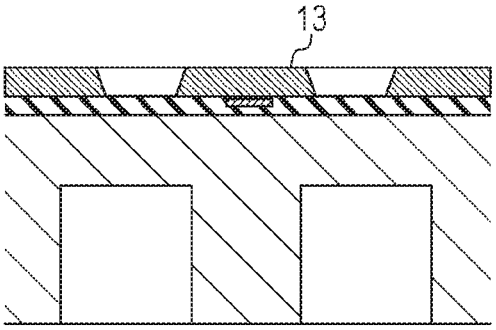

Next, the etching mask 12 is removed, and, as illustrated in FIG. 7C, an etching mask 13 is provided on the front surface side of the substrate 1. The etching mask 13 is formed of, for example, the same material as the material of the etching mask 12. The sectional shape of an open portion of the etching mask 13 may be a tapered shape. The tapered shape can be formed by optimizing exposure conditions, post exposure bake (PEB)/development conditions, and prebaking conditions for a patterning process.

Next, as illustrated in FIG. 7D, the opening 9 is formed in the insulation layer 5 by subjecting the insulation layer 5 to reactive ion etching. FIG. 7D shows a state in which the etching mask 13 has been removed.

Next, as illustrated in FIG. 7E, an etching mask 14 is formed on the front surface side of the substrate 1. The etching mask 14 is also formed of, for example, the same material as the material of the etching mask 12. Then, the second supply passage 3 is formed by etching the substrate 1. The position at which the second supply passage 3 is formed is inside the opening 9. At least on the side where the energy generating element 4 is disposed, the second supply passage 3 is formed inside the opening 9 so as to be spaced from the opening 9. Thus, the second supply passage 3 is formed by performing etching in a state in which the etching mask 14 is also disposed inside the opening. As a result, it is possible to dlspose the insulation layer such that the end portion thereof adjacent to the opening of the supply passage is set back from the edge of the opening of the supply passage toward the side where the energy generating element is disposed.

Figure 7F:
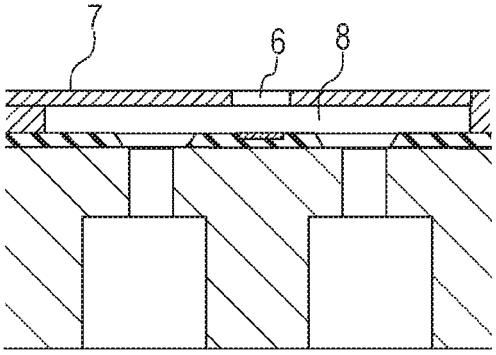

Then, the etching mask 14 is removed, and as illustrated in FIG. 7F, the discharge port member 7 that forms the channel 8 and the discharge port 6 is disposed. The discharge port member 7 may be formed of, for example, a plurality of dry films. Examples of the dry films include a polyethylene terephthalate (hereinafter referred to as PET) film, a polyimide film, and a polyamide film. After the dry films are stuck to the substrate 1, a support member of the dry films is peeled off. Thus, release promoting treatment may be performed between the dry films and the support. member in advance.

As described above, the liquid discharge head according to the present embodiment of the disclosure is manufactured.

Exemplary Embodiments

The present disclosure is more specifically described below on the basis of exemplary embodiments.

First Exemplary Embodiment

A method of manufacturing the liquid discharge head will be described. First, as illustrated in FIG. 7A, the substrate 1 that is provided, on the front surface side thereof, with the energy generating element 4 formed of TaSiN, the insulation layer 5 formed of silicon oxide, and the electric wiring layer (not shown) formed of Al is prepared. The substrate 1 is a single-crystal silicon substrate. The insulation layer 5 includes multiple layers and has a thickness of 10 μm. Four electric wiring layers are provided in the insulation layer 5 and connected together via tungsten plugs.

Next, as illustrated in FIG. 7B, the etching mask 12 is provided on a rear surface, opposite to the front surface, and the first supply passage 2 is formed by reactive ion etching. The etching mask 12 is formed of silicon oxide. The first supply passage 2 has a depth of 500 μm. Conditions for the etching include using $SF_6$ gas in an etching step and $C_4F_8$ gas in a coating step, and employing a gas pressure of 10 Pa and a gas flow rate of 500 sccm. In addition, the conditions include employing an etching period of 20 seconds and a coating period of 5 seconds and applying a platen power of 150 W for 10 seconds in the etching period. Note that above reactive ion etching is an etching method called the Bosch process.

Next, the etching mask 12 is removed, and as illustrated in FIG. 7C, the etching mask 13 is provided on the front surface side of the substrate 1. To form the etching mask 13, a novolac positive resist of a thickness of 20 μm is first applied and subjected to pre-baking at a temperature of 150° C. Next, exposure and development are performed to form the etching mask 13. In the exposure, the focus is set at a position 5 μm above the top of the resist to slightly defocus. The opening of the etching mask 13 has an obtuse taper angle of 100°.

Next, the etching mask 13 is removed, and as illustrated in FIG. 7D, the opening 9 is formed in the insulation layer 5 by subjecting the insulation layer 5 to reactive ion etching. The reactive ion etching is performed by using a mixed gas of $C_4F_8$ gas, $CF_4$ gas, and Ar gas and employing the flow rate of 10 sccm for the $C_4F_8$ gas and a platen power of 100 W. In the etching, the substrate 1 formed of silicon functions as an etching stop layer. In other words, when etching of the insulation layer proceeds, an etching region (etching gas) reaches the substrate 1. A selection ratio between the insulation layer 5 and the substrate 1 is 100 or more. Thus, the etching is stopped when the etching reaches the substrate 1. As described above, the substrate 1 is used as the etching stop layer. Note that when 20% over-etching is performed after the insulation layer 5 is etched by 10 μm, an etching amount of the substrate 1 is calculated to be 0.02 μm. Therefore, the height of the insulation layer 5 substantially equals to the height of the opening 9.

Next, as illustrated in FIG. 7E, the etching mask 14 is formed. The etching mask 14 having a film thickness of 20 μm is formed by using a novolac positive resist and patterned by photolithography. An opening of the etching mask 14 is formed at a position inside the opening 9. The substrate 1 is then subjected to reactive ion etching to thereby form the second supply passage 3.

After that, the etching mask 14 is removed, and as illustrated in FIG. 7F, the discharge port member 7, which forms the channel 8 and the discharge port 6, is formed by sticking epoxy resin-containing dry films to the substrate 1.

As described above, the liquid discharge head according to the present disclosure is manufactured. According to the first exemplary embodiment, the liquid discharge head is highly efficiently manufactured. Moreover, the liquid discharge head has low liquid flow resistance and high reliability.

Second Exemplary Embodiment

The liquid discharge head illustrated in FIG. 6 is manufactured. Features different from those in the first exemplary embodiment will be mainly described.

After the opening 9 is formed by the same manner as that in the first exemplary embodiment, an etching mask to be used to form the second supply passage 3 is provided. Then, the second supply passage 3 is formed by the Bosch process. As conditions for the etching by the Bosch process, conditions that enable the second supply passage 3 to be widened more outwardly are employed for an early stage of the etching step in order to widen the second supply passage 3 more outwardly than the opening 9. Specifically, the conditions include using $SF_6$ gas in the etching step and $C_4F_8$ gas in the coating step and employing a gas pressure of 10 Pa and a gas flow rate of 500 sccm. In addition, the conditions include employing an etching period of 20 seconds and a coating period of 5 seconds and applying a platen power of 150 W for 10 seconds in the etching period. These conditions are employed such that etching by the Bosch process is performed by an amount larger than the thickness of a protection film formed in the coating step to widen the opening of the second supply passage 3. When the second supply passage 3 is formed by the Bosch process, it is possible to employ a high etching selection ratio with respect to the insulation layer 5. Thus, the substrate 1 is slightly etched with the insulation layer 5, which makes it easy to form a protruding portion of the insulation layer 5.

As described above, the liquid discharge head according to the second exemplary embodiment is manufactured. According to the second exemplary embodiment, the liquid discharge head is highly efficiently manufactured. Moreover, the liquid discharge head has low liquid flow resistance and enables liquid to flow easily compared with the first exemplary embodiment. Thus, the liquid discharge head is highly reliable.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-127997 filed Jun. 29, 2017, which is hereby incorporated by reference herein in its entirety.

What is claimed is:

1. A liquid discharge head comprising:

a substrate that is provided with a supply passage having an opening on a surface side of the substrate and through which a liquid is supplied onto the surface side of the substrate;

an energy generating element that is disposed on a surface of the substrate and generates energy for discharging a liquid;

an electric wring layer that is electrically connected to the energy generating element;

an insulation layer that electrically insulates the electric wiring layer from the liquid; and a discharge port member that forms a discharge port through which the liquid is discharged;

wherein the insulation layer has an end portion adjacent to the opening of the supply passage, the end portion being set back from an edge of the opening of the supply passage toward a side where the energy generating element is disposed, and wherein the electric wiring layer includes a plurality of electric wiring layers layered on each other.

2. The liquid discharge head according to claim 1, wherein the end portion of the insulation layer is an inclined surface inclined with respect to the surface of the substrate.

3. The liquid discharge head according to claim 2, wherein the inclined surface and the surface of the substrate form an angle of 45 degrees or more and less than 90 degrees.

4. The liquid discharge head according to claim 1, wherein the insulation layer electrically partially insulates the plurality of electric wiring layers from each other.

5. The liquid discharge head according to claim 1, wherein the insulation layer has a thickness of 4 μm or more.

6. The liquid discharge head according to claim 1, wherein the insulation layer is formed of at least one of silicon nitride, silicon carbide, and silicon oxide.

7. The liquid discharge head according to claim 1, wherein when the liquid discharge head is viewed from a position opposite the surface of the substrate, the end portion of the insulation layer forms an opening, the opening of the insulation layer having a center that does not coincide with a center of the opening of the supply passage.

8. The liquid discharge head according to claim 1, wherein L2/L1 is 0.2 or more where L1 is a distance between the edge of the opening of the supply passage and a center of the energy generating element, and L2 is a distance between the edge of the opening of the supply passage and the end portion, which is adjacent to the opening of the supply passage, of the insulation layer.

9. The liquid discharge head according to claim 8, wherein the L2/L1 is 0.3 or more.

10. The liquid discharge head according to claim 1, wherein a channel for the liquid is provided between the discharge port member and the surface of the substrate, and wherein D2/D1 is 0.2 or more where D1 is a height of the channel, and D2 is a thickness of the insulation layer.

11. The liquid discharge head according to claim 10, wherein the D2/D1 is 0.5 or more.

12. The liquid discharge head according to claim 10, wherein the D2/D1 is 1.0 or more.

13. The liquid discharge head according to claim 1, wherein the insulation layer protrudes, from a side of the supply passage opposite the side thereof where the energy generating element is disposed, over the opening of the supply passage.

14. The liquid discharge head according to claim 13, wherein a length of a portion of the insulation layer protruding over the opening of the supply passage is 0.1 μm. or more and not more than 3.0 μm.

15. A recording apparatus comprising:

the liquid discharge head according to claim 1; and a liquid storage part that stores a liquid to be supplied to the liquid discharge head.

* * * * *